US006082498A

United States Patent [19]

Coste et al.

[11] Patent Number: 6,082,498

[45] Date of Patent: Jul. 4, 2000

[54] NORMAL THERMAL STOPPING DEVICE WITH NON-CRITICAL VANE SPACING

[75] Inventors: Steven D. Coste, Berlin; Sally D. Mahoney, Forestville, both of Conn.

[73] Assignee: Otis Elevator, Farmington, Conn.

[21] Appl. No.: 09/234,844

[22] Filed: Jan. 22, 1999

[51] Int. Cl.[7] ..... B66B 1/28

[52] U.S. Cl. ..... 187/291; 187/294; 187/284; 187/394

[58] Field of Search ..... 187/284, 291, 187/293, 294, 391, 394

[56] References Cited

U.S. PATENT DOCUMENTS

| | | | |
|---|---|---|---|
| 3,743,055 | 7/1973 | Hoelscher et al. | 187/29 R |
| 3,773,146 | 11/1973 | Dixon, Jr. et al. | 187/29 R |
| 4,503,939 | 3/1985 | Lawrence et al. . | |
| 4,515,247 | 5/1985 | Caputo | 187/29 R |
| 4,570,755 | 2/1986 | Tsai et al. | 187/29 R |
| 4,658,935 | 4/1987 | Holland | 187/122 |
| 4,691,807 | 9/1987 | Iwata . | |
| 5,345,048 | 9/1994 | Towey, Jr. . | |
| 5,407,028 | 4/1995 | Jamieson et al. . | |
| 5,637,841 | 6/1997 | Dugan et al. | 187/394 |
| 6,032,761 | 3/2000 | Coste et al. | 187/294 |

*Primary Examiner*—Jonathan Salata

[57] ABSTRACT

A normal terminal stopping device (NTSD) using terminal zone position checkpoint detection with a binary coding method to identify a checkpoint within a terminal zone, and a digital shaft encoder mounted on the shaft of the hoist motor to determine a car position relative to a target stopping point. A microprocessor-based controller is used to compare a velocity command signal to a velocity limit reference. If the velocity command exceeds the velocity limit, the NTSD functions will take over to cause the elevator car to decelerate at the NTSD rate. In particular, the velocity limit reference is computed according to lead compensation and curve shaping techniques to attain better drive tracking characteristics of the motion controller. Binary coded checkpoints are used to eliminate error introduced in a car position derived from a motor shaft digital encoder. The normal terminal stopping device and method according to the present invention is less sensitive to the vane spacing as compared to the conventional NTSD designs.

14 Claims, 6 Drawing Sheets

NORMAL THERMAL STOPPING DEVICE WITH NON-CRITICAL VANE SPACING

BACKGROUND OF THE INVENTION

1. Technical Field of the Invention

This invention relates to a terminal speed limiting device for an elevator and, more specifically, to improvements in the protection provided by the Normal Terminal Stopping Device in the hoistway.

2. Discussion of Related Art

It is known in the elevator art to define terminal zones at both ends of the elevator hoistway. The top landing of the building will normally be located within the top terminal zone as will the lower landing be located within the bottom terminal zone. It is desired that the elevator car stop normally at a top or bottom landing of the hoistway in such a terminal zone. As a safety measure, it is necessary to provide a number of backup means to ensure the elevator car does not collide with the mechanical hard-limits. Three levels of protection are usually provided when the elevator enters a terminal zone: the Normal Stopping Device, the Normal Terminal Stopping Device (or NTSD), and the Emergency Terminal Speed Limiting Device (or ETSLD). The present invention is concerned with NTSD which will take over from the Normal Stopping Device should the normal speed control signals fail to stop the car at the designated positions at the upper and lower ends of the hoistway. Two similar NTSDs are usually provided in the two terminal zones. One NTSD is installed at the bottom of the hoistway and one NTSD at the top of the hoistway. The NTSD system is designed to override the normal speed command signals and bring the car to stop at the terminal. It is also designed such that the NTSD terminal speed profile causes the slowdown pattern to be relatively smooth.

It is known in the art to mount a number of vanes in the hoistway and a sensor or sensors mounted on the car to read the vane identification for locating the position of car in the hoistway, and means to determine the velocity of the car in the terminal zone. For example, U.S. Pat. No. 5,637,841 (Dugan et al.) discloses an elevator system in which an NTSD system is used as a backup system. In particular, the NTSD system, according to Dugan et al, includes two operating modes: a monitor mode and a violation mode. The NTSD system normally operates in monitor mode where the NTSD speed profile has the same deceleration rate as the normal speed profile in the Normal Stopping Device. But when the velocity of the car exceeds the predetermined NTSD monitoring speed profile, or the maximum allowable NTSD speed profile for various car positions in the terminal zone during deceleration, the system substitutes the NTSD speed profile and switches to an NTSD violation speed profile for deriving subsequent NTSD speed values. The NTSD violation profile has a steeper deceleration slope than that of the profile in the monitor mode.

It is desirable to simplify the NTSD system so that only one operating mode will be used in the derivation of the NTSD speed profile. Furthermore, in the prior art NTSD designs, vanes are mounted in the hoistway using either a non-linear or linear spacing approach and this requires very tight control on vane spacing. In the limited space of the hoistway, the tight control of vane spacing sometimes becomes impractical. It is, therefore, desirable to provide an NTSD wherein the spacing criticality of vane installation can be relaxed.

SUMMARY OF THE INVENTION

It is an objective of the present invention to provide a method and apparatus for generating an NTSD speed profile which does not require the tight control of vane spacing. Moreover, the NTSD in accordance with the present invention uses only one speed profile in the controlling of the elevator car in the terminal zone.

According to the first aspect of the invention, an elevator hoistway terminal zone position checkpoint detection apparatus, comprises a stationary part having plural elongated sections, for vertical mounting along a terminal zone of an elevator hoistway; and a movable part for mounting on an elevator car movable in said hoistway to sense said stationary part as indicative of position checkpoints in said terminal zone and to provide a sensed output signal indicative of said position checkpoints. The elongated sections of the stationary part may include vanes or some other applicable sensor target for mounting along the terminal zone of the elevator hoistway. In the case of vanes, the movable part may preferably comprise four sensors, such as optical sensors, for sensing such targets. Furthermore, the elongated sections of the stationary part may comprise a light reflective means for mounting along said terminal zone of the elevator hoistway. In that case, the movable part comprises optical sensors for transmitting and sensing the light transmitted to and reflected back from the reflective sensor target. Yet another way is to have the elongated sections of the stationary part comprising a magnetic strength indication means for mounting along said terminal zone of said elevator hoistway. In that case, the movable part comprises magnetic sensors for sensing, for example, the magnetic field variation caused by the stationary part.

According to a second aspect of the present invention, an elevator safety device comprises: an elevator hoistway terminal zone position checkpoint detection means utilizing a binary coding method for providing a binary coded output signal indicative of position checkpoints in an elevator hoistway terminal zone; a decision means, responsive to the binary coded output signal, for retrieving a velocity reference signal corresponding to a position checkpoint associated with the binary coded signal and for comparing said velocity reference signal to a velocity command signal indicative of a desired velocity of an elevator car in the elevator hoistway as provided by the normal velocity control (including the normal stopping means); said decision means, based on the velocity comparison, for causing the elevator car to travel with a velocity corresponding to the velocity reference signal in the presence of the velocity command signal being greater than the velocity reference signal.

According to a third aspect of the invention, a method comprises the steps of (1) receiving a binary coded sensed output signal indicative of one of a plurality of position checkpoints in an elevator terminal zone of an elevator hoistway; (2) retrieving, in response to the binary coded sensed output signal, a velocity reference signal associated with said one checkpoint; (3) retrieving a car velocity command signal having a magnitude indicative of a desired velocity of an elevator car moving in the elevator hoistway; and (4) comparing the velocity reference signal to the car velocity command signal for causing the elevator car to assume a velocity corresponding to the velocity reference signal in the presence of the car velocity command signal having a magnitude greater than the velocity reference signal.

According to a fourth aspect of the invention, a method of computing the velocity reference signal comprises the steps of (1) receiving a binary coded sensed output signal indicative of each of a plurality of position checkpoints in an elevator terminal zone of an elevator hoistway; (2) retrieving, in response to the binary coded sensed output signal, a position signal indicative of the distance of the checkpoint relative to a reference point; (3) computing a velocity reference signal at the checkpoints in accordance with the position signal using a lead compensation method; (4) computing a velocity reference signal between said position checkpoints using a curve shaping technique; and (5) storing said velocity reference signal for each of said plural checkpoints.

As described above, the NTSD system, according to preferred embodiment of the present invention, preferably uses four discrete sensors mounted to the elevator car to detect vanes mounted in the hoistway, together with a digital shaft encoder mounted on the shaft of the hoist motor to determine the checkpoint positions associated with the vanes. Among the four sensors, three are arranged such that a three-bit binary coded signal is produced when this three-sensor group detects a NTSD vane in the hoistway. The three-bit code is used to distinguish a given NTSD vane from any other NTSD vane within the same terminal zone. The fourth of the four sensors is used to indicate to a microprocessor-based controller that the sensing of the three-sensor group is valid. This indication of validity shall herein be referred to as an NTSD "Checkpoint" and the three-bit binary code shall herein be referred to as the "Checkpoint Identifier". With a three-bit checkpoint identifier, up to 8 checkpoints (0 through 7) may be provided per NTSD terminal zone, but less than 8 checkpoints can also be used while retaining the checkpoints 0 and 7 as a minimum. Binary coded checkpoints are used to eliminate error introduced in a car position derived from a motor shaft digital encoder.

One of the features of the present invention include the shifting of the zero-coded checkpoint away from the terminal floor level position so as to alleviate the problems usually associated with a well-known "crowding" phenomenon as the NTSD velocity reference curve and the NORMAL velocity curve tend to converge when the elevator car gets closer to the terminal floor level position. The shifting of the zero-coded checkpoint will be illustrated in FIG. 1.

In addition, a lead compensation algorithm and a curve shaping technique are used to compute the NTSD velocity reference curve so as to attain better drive tracking characteristics of the motion controller. As a result, less position control error will occur during an NTSD stop, and the system can be more tolerant to a tighter separation between the NTSD and ETSLD curves. The lead compensation and curve shaping techniques will be illustrated in FIG. 2.

As a further countermeasure to the "crowding" phenomenon, the ETSLD is designed to afford the highest possible separation between the NTSD and ETSLD checkpoint velocities. This separation can be seen in FIG. 4.

With these improvements, the normal terminal stopping device becomes less sensitive to the crowding as compared to the conventional NTSD.

Another aspect of the present invention is to provide a position signal derived continuously from the PVT and error corrected by the NTSD checkpoints. This eliminates the need to interpolate between checkpoints.

BRIEF DESCRIPTION OF TUBE DRAWING

Figure 5A:
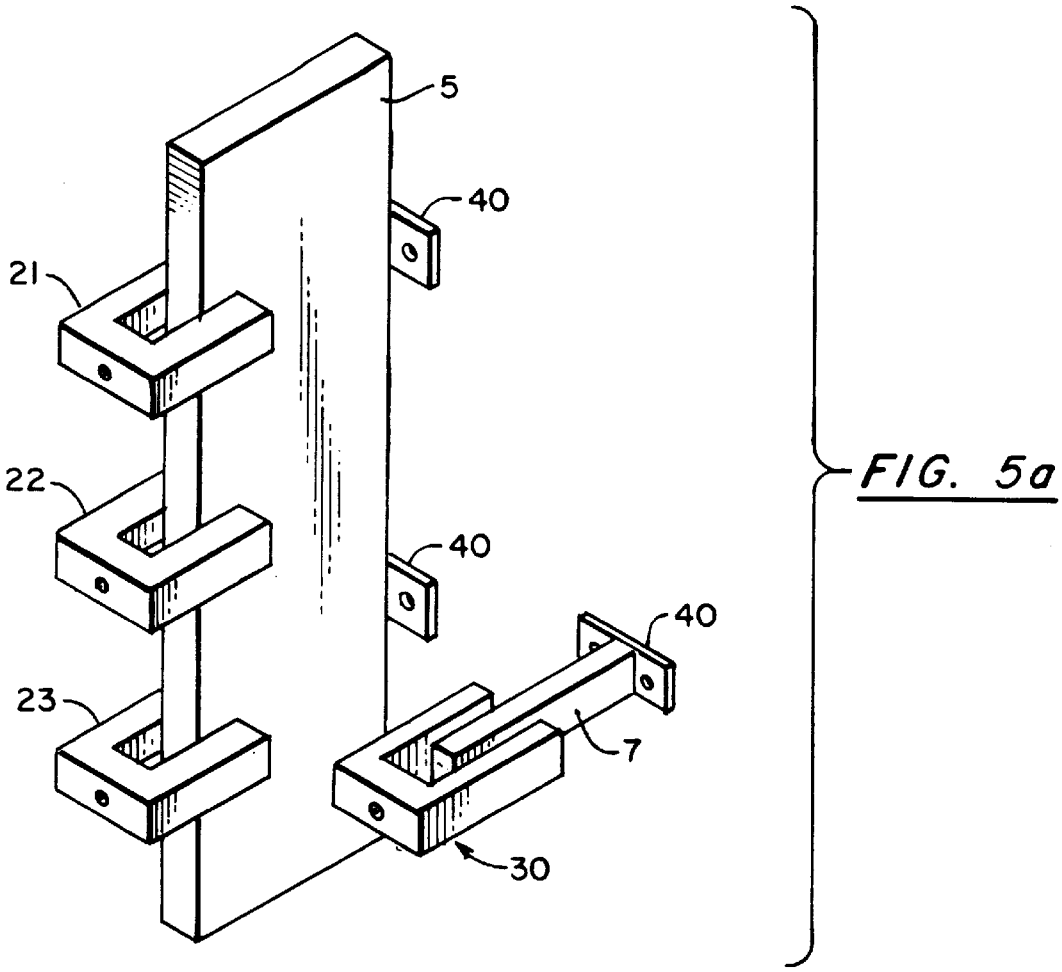

FIG. 5*a* illustrates the grouping of sensors in the hoistway for checkpoint detection.

Figure 5B:
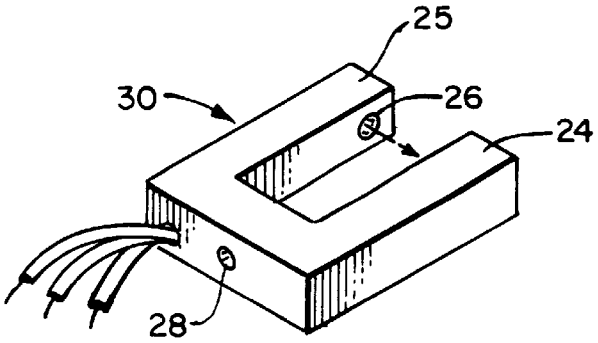

FIG. 5*b* illustrates an optical sensor.

Figure 5C:
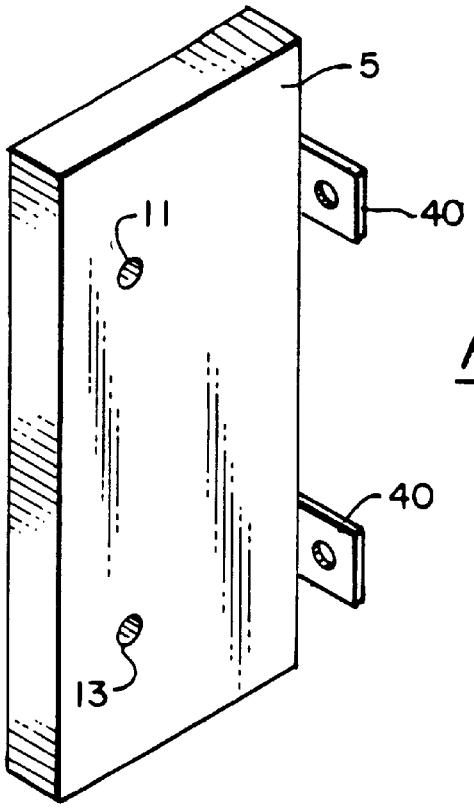

FIG. 5*c* illustrates a vane having holes for providing a binary coded signal.

Figure 5D:
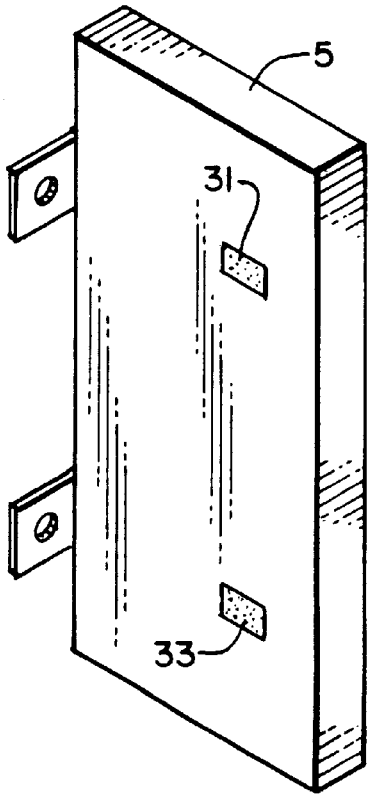

FIG. 5*d* illustrates a vane having light reflecting targets for providing a binary coded signal.

DETAILED DESCRIPTION OF THE INVENTION

Figure 1:
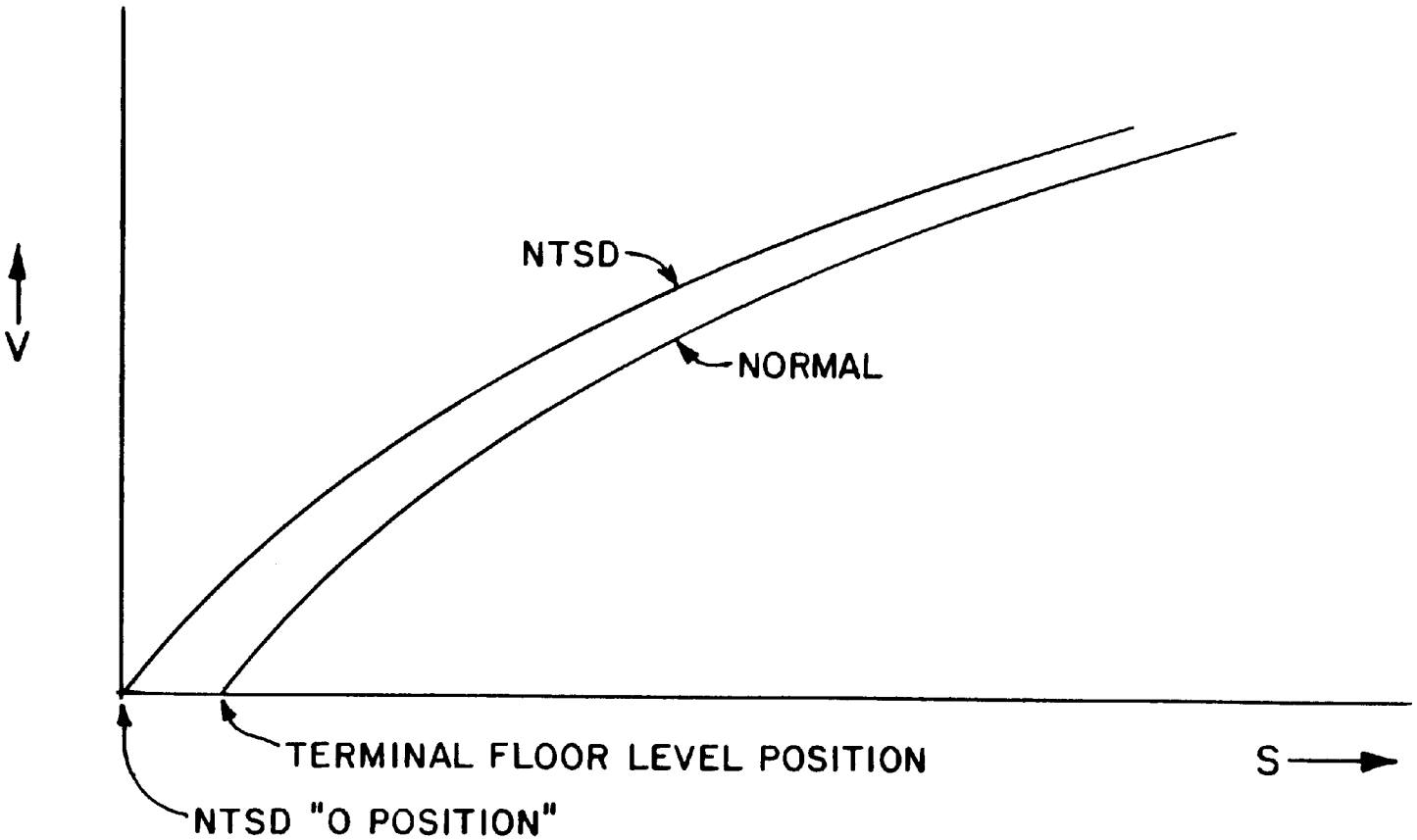
FIG. 1 illustrates the shifting of the zero-coded checkpoint so as to separate the NTSD and the NORMAL velocity curves.

FIG. 1 illustrates the shifting of the zero-coded checkpoint so as to separate the NTSD and the NORMAL velocity curves. Usually the NORMAL velocity curve and the NTSD curve tend to converge as the car gets closer to the terminal floor level position. This phenomenon is commonly referred to as "crowding" and must be dealt with so that the NTSD does not erroneously actuate and take control when all is well. In order to alleviate the problems associated with the "crowding" phenomenon, the zero-coded checkpoints, or the NTSD curve "zero position" is shifted from the terminal floor level position by, e.g., 50% of the inner door zone distance. The shifting of the NTSD curve "zero position" is designed so that the NTSD target position for stopping is located at, e.g., 38 mm past the terminal floor level position. The separation distance between the NORMAL and NTSD stopping positions can be seen in FIG. 1, at V=0.

It should be noted that the shifted distance can also be smaller or larger than 50% of the inner door zone distance, and the 38 mm distance is designed only for a certain inner door distance.

Figure 2:
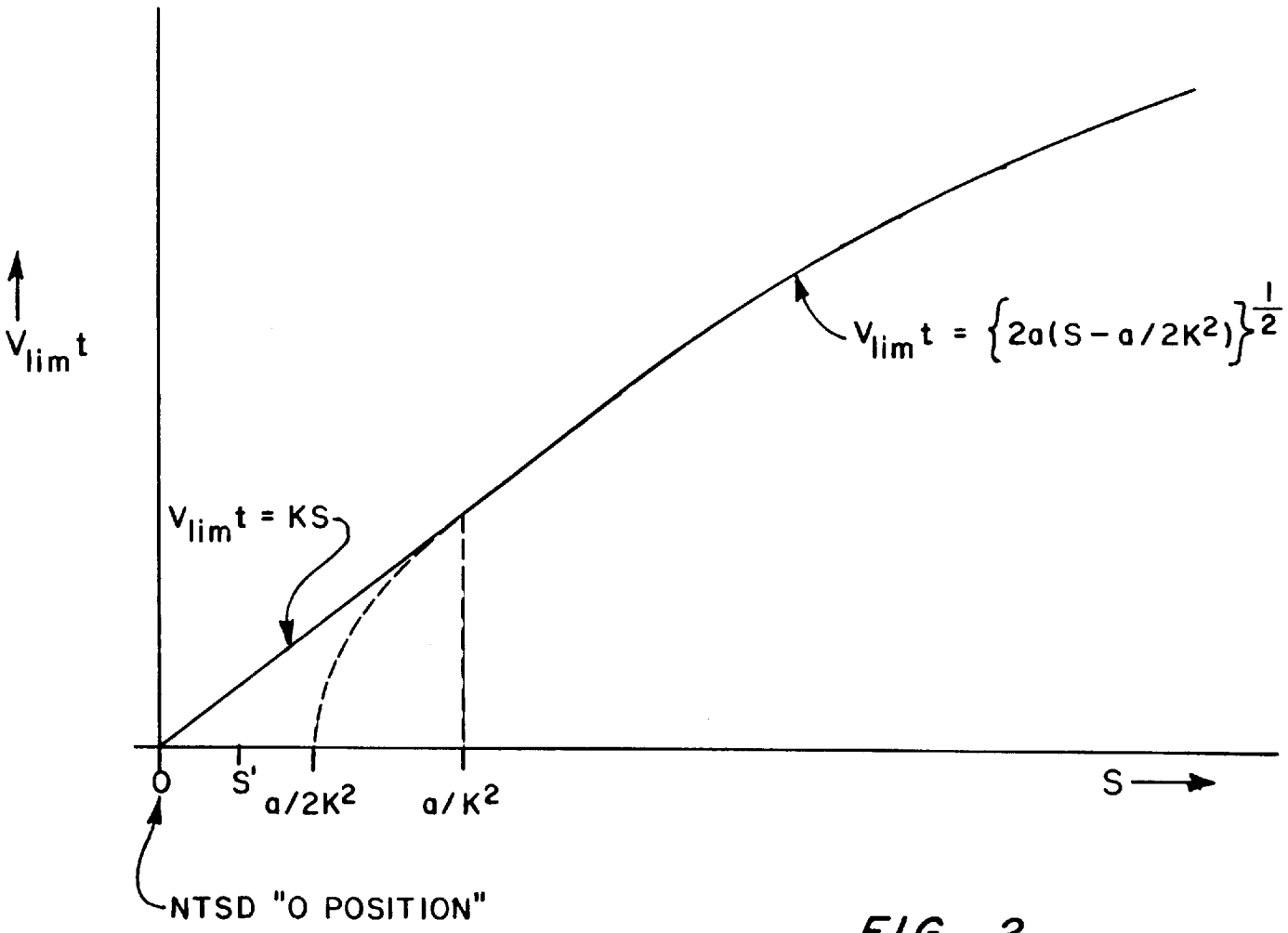
FIG. 2 illustrates details of the NTSD velocity profile in the proximity of the NTSD "0 position".

FIG. 2 illustrates details of the NTSD velocity profile in the proximity of the NTSD "0 position". Conventionally, the NTSD velocity profile is derived from the square-root relationship between velocity and distance. In a real system the square-root relationship cannot be used by itself because it does not take into account limitations in motion controller bandwidth. To deal with a real system, the NTSD curve, according to the present invention, is generated using lead (or look ahead) compensation and curve shaping techniques so as to limit the deceleration as the elevator car approaches the NTSD target stopping position.

The NTSD velocity limit is derived from the following equation:

$$V_{lmt}=\{2a(S-a/2K^2)\}^{1/2},\ S\geqq a/K^2 \quad (1)$$

$$V_{lmt}=KS,\ S<a/K^2 \quad (2)$$

In the above equations, S is the lead compensated position of the car relative to the NTSD "0 position", and K(1/sec) is the bandwidth constant which is related to the limitations in the motor controller. In general, K is adjustable between 0.5 and 3, but is preferably defaulted to 3. The lead compensation position, S, is obtained in a fashion as described below. Prior to using the measured value for S in the $V_{lmt}$ equation, S is compensated using a lead filter to anticipate and eliminate the drive system's tracking delay or response lag. This provides better control when an NTSD trip or actuation occurs, where a transition must be made from using the normal stopping means to using NTSD. Based on the nature of the dictation pattern for both the normal and NTSD, it is reasonable to predict that the car is lagging behind a certain amount of time but so as to follow the relationship between ($V_o t+at^2/2$) and the difference in distance (for $S\geqq a/K^2$). If $V_o$ is the previous execution cycle value for $V_{lmt}$ and a is the defined rate of NTSD deceleration, then, after selecting and adjusting in a "Look Ahead" value for t, the car position S is reduced by the result of the above-mentioned relationship prior to its being used to calculate the value of $V_{lmt}$ for the current execution cycle.

A plot of the NTSD velocity limit against the car position S is shown in FIG. 2. In FIG. 2, S' denotes the terminal floor level position. When the elevator car is away from the NTSD "zero position", or $S \geqq a/K^2$, the velocity limit is calculated using the square-root relationship between velocity and distance under constant deceleration, as given in Eq. 1. As the elevator car approaches the target position for stopping, the computation of the velocity limit profile starts to change at the transition point $S=a/K^2$. From the transition point to the target stopping position, the elevator car is not slowed down at a constant rate. Instead, the deceleration of the elevator car is more gradual and is linearly proportional to the velocity itself. It should be noted that the slope of the velocity profile, $dV/dS=a/V$, at the transition point $S=a/K^2$ is equal to K and is continuous. Thus, the transition of velocity limit from Eq. 1 to Eq. 2 is smooth.

Figure 3:
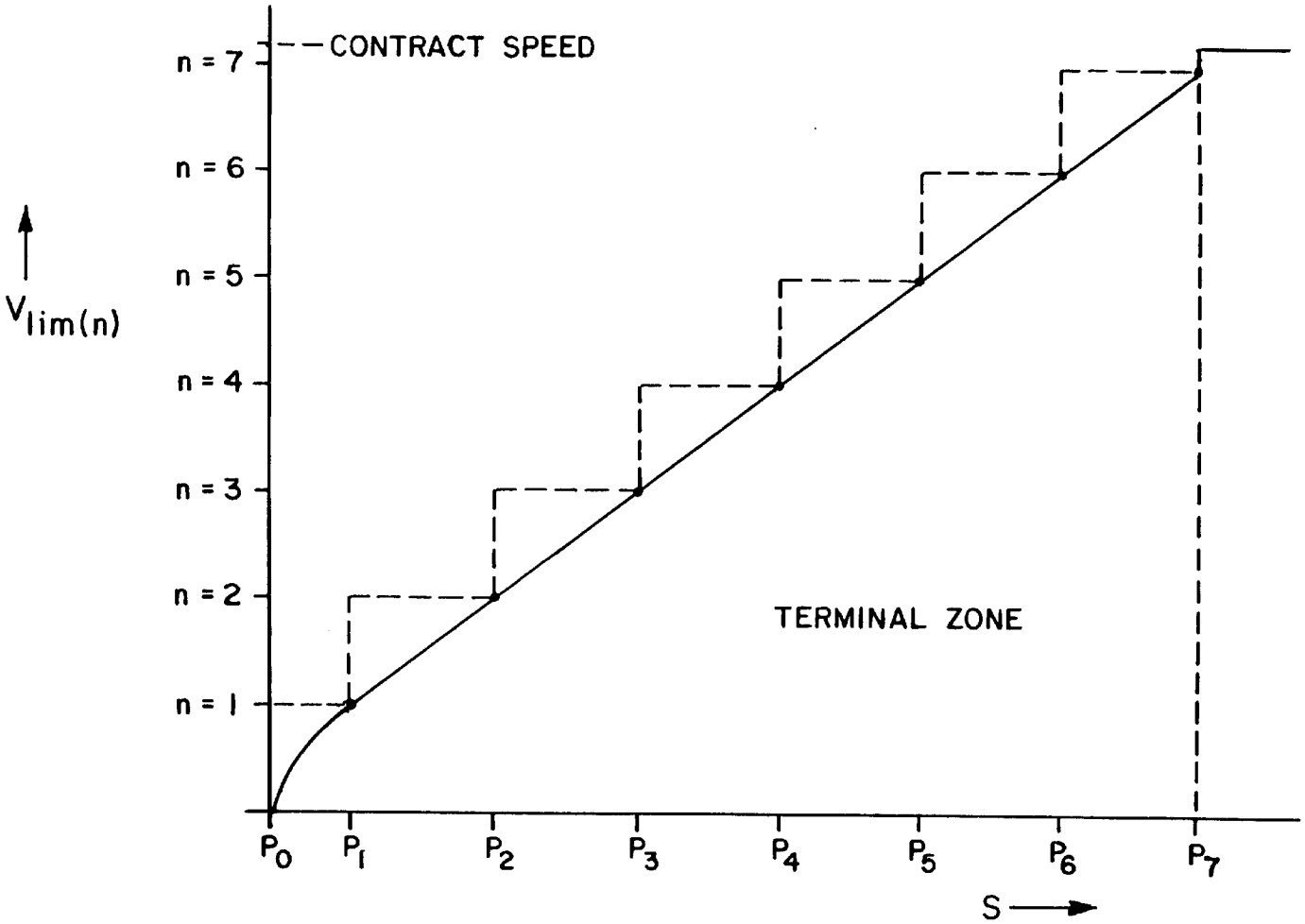
FIG. 3 illustrates discrete velocity limits $V_{lmt(n)}$ being plotted against checkpoint positions and an NTSD velocity limit profile fitting these discrete points.

FIG. 3 illustrates the discrete velocity limits $V_{lmt(n)}$ being plotted against the checkpoint positions. The plot shows a number of actual velocity readouts (n=0 through 7) obtained by the normal elevator control mechanism at eight checkpoints $P_0, P_1, \ldots, P_7$. As shown, the velocity limit at the last checkpoint, $P_7$, is slightly less than the contract speed. The last checkpoint, or the seven-coded checkpoint, is positioned at a distance computed from the following equation:

$$P_7=\{(C\times V_{contract})^2/2a\}+a/2K^2 \quad (3)$$

In Eq. 3, $P_7$ is the position of the last checkpoint, C is a value between 1.00 and 0.95 or smaller, a is the desired NTSD deceleration rate, and K is the bandwidth constant associated with the motion controller. The reason for the restriction that the value of the last checkpoint position be associated with a velocity value between 95 and 100% of $V_{contact}$ is to ensure that the NTSD is active when the car is running at near (or within 5% of) contract speed and it is desired to be 100%. It is also desired, but not mandatory, that the balance of the intermediate checkpoints (1 through 6, for example) be evenly distributed over the distance between the last checkpoint and the NTSD "0 position" so as to minimize cumulative error in the displacement measured with the hoist motor encoder. A linear or equal spacing method may be chosen as a best mode goal for the distribution of the checkpoints, according to the present invention. But the actual location of the checkpoints may deviate from the spacing method due to mounting and interference considerations. The normal terminal stopping device and method, according to the present invention, allow the actual location of the checkpoints to deviate from the linear or equal spacing method due to the fact that this NTSD design is less sensitive to the vane spacing as compared to the conventional NTSD designs. Furthermore, a non-linear spacing method may also be used for checkpoint distribution.

The number of checkpoints in the hoistway can be less than 8 if a two or three-bit binary coded signal is used to identify the checkpoints. But it can also be more than 8 if a four or more bit binary coded signal is used. It should also be realized that it is a common practice to have a digital shaft encoder mounted on the shaft of the hoist motor. This shaft encoder, which is also known as the PVT counter, can be used to track the displacement and the direction of the elevator car between checkpoints. The velocity command is obtained from the normal elevator control mechanism which is not part of the present invention. Also, it should be realized that common failures inherent to the hoistway motor drive system are handled by the hoistway motor drive system, and are thereby outside the scope of this invention.

During initial installation and adjustment procedures, a "Learn Mode" is carried out so as to measure, from the PVT encoder counter, the displacement between each checkpoint relative to the zero-coded checkpoint. With the displacement information, the terminal relative distance, preferably in millimeters, of each checkpoint from the NTSD "0 position" is established. This is done using a predefined and adjustable scaling factor for translating the PVT encoder counters to millimeters of car movements. The terminal relative distance of each checkpoint is stored for later uses. Furthermore, in the "Learn Mode", a NTSD velocity limit, $V_{lmt(n)}$, is calculated for each checkpoint based on the terminal relative distance of that checkpoint. The calculated velocity limit at each checkpoint is used to produce the NTSD velocity profile as shown in FIG. 3.

The following NTSD learn process, presenting the best mode of the present invention, is performed within, or as part of, the overall controller learn process:

- Position the car so that the NTSD checkpoint sensors are below the NTSD zero-coded checkpoint in the terminal.
- Run the car up the hoistway until the NTSD checkpoint sensors are above the NTSD zero-coded checkpoint in the top terminal zone.
- While the car is running up, and when the bottom terminal zone zero-coded checkpoint is encountered, or when the top terminal zone seven-coded checkpoint is encountered, set the PVT encoder counter difference for that particular checkpoint to zero and initialize the PVT encoder pulse counter from the last checkpoint to zero.
- When any NTSD checkpoint other than the bottom terminal zero-coded checkpoint or the top terminal seven-coded checkpoint is encountered, set the PVT encoder counter difference for that particular checkpoint to the current PVT encoder pulse count from the last checkpoint and initialize the PVT encoder pulse count from the last checkpoint to zero. (That is, store the number of PVT counts that have occurred from the last checkpoint—this is used to measure car travel between checkpoints in PVT counts).
- When any NTSD checkpoint is encountered, record the value of primary car position for that checkpoint.
- When all checkpoints have been acquired, calculate and store the "Terminal Relative" distance from the NTSD "0 position" in millimeters for each checkpoint. This is done using a predefined and adjustable scaling factor for translating PVT encoder counts to millimeters of car movement. If this scaling factor is ever changed due to some calibration process external to the present invention, this calculation is automatically run again, without the need of performing another learn run (so long as the checkpoint positions and the PVT resolution do not change). The calculation is performed by summing the measured differences between checkpoints and converting the sum to millimeters.

Figure 4:
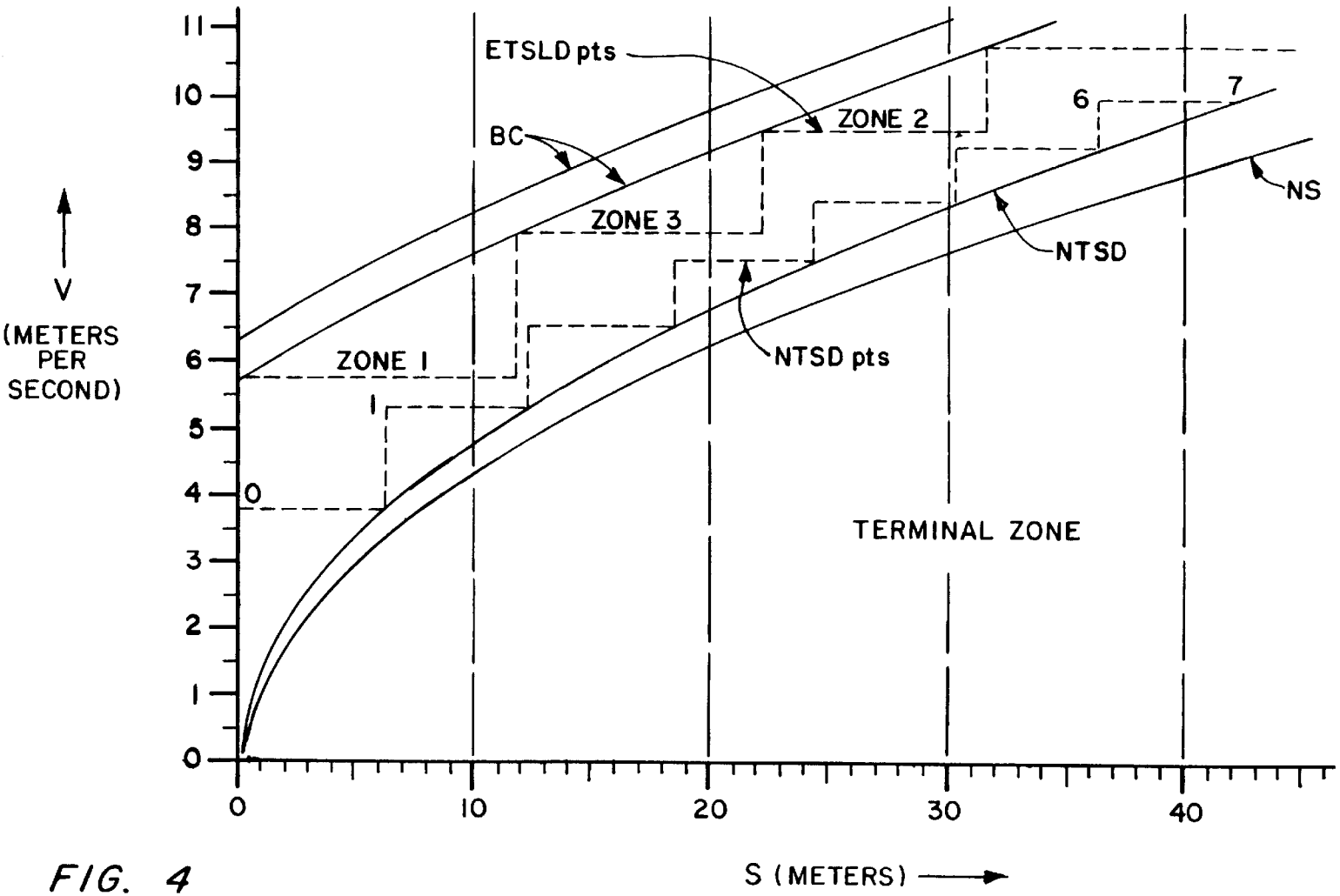
FIG. 4 illustrates the NTSD velocity profile along with other velocity curves.

FIG. 4 illustrates the NTSD velocity profile along with other velocity curves. As shown in FIG. 4, the velocity is expressed in terms of meters per second while the distance is expressed in meters. The curves labeled NS, NTSD, NTSD pts, ETSLD pts are, respectively, the normal stopping curve to be used with the Normal Stopping Device, the NTSD velocity limit profile to control the elevator car in a terminal zone, the NTSD velocity limits at the checkpoints, and the velocity limits at checkpoints associated with the Emergency Terminal Speed Limiting Device. BC are braking curves to be used in case of emergency. As shown in FIG. 4, the NORMAL velocity curve and the NTSD curve are separated even when the elevator car approaches the terminal floor level position. This separation is shown in detail in FIG. 1. The NTSD velocity limit profile near the NTSD "0 position" is shown in detail in FIG. 2. During normal elevator operations, when a valid checkpoint is encountered, the microprocessor-based controller refers to stored data to obtain the terminal relative distance, S, of the checkpoint, and computes the NTSD velocity limit for that particular checkpoint using prescribed formulae (Eq. 1 and Eq. 2). The controller also computes a velocity command based on the distance measured from the primary position system and compares the velocity command against the NTSD velocity limit. If the velocity command does not exceed the corresponding NTSD limit when the elevator car is traveling toward a terminal, the velocity command is allowed to pass through unaffected to the hoist control functions. Should the velocity command exceed the NTSD velocity limit, the NTSD functions will supersede the normal command stream and provide a velocity command stream so as to cause the car to decelerate using the NTSD trajectory, beginning at the current NTSD velocity limit value and ending at a zero valued velocity command. The present invention deems any transitional errors, when transitioning from the normal trajectory to the NTSD trajectory, manageable by the hoist control when this invention is coupled with an optimized ETSLD design that provides maximum separation between NTSD and ETSLD. This, therefore, eliminates the need for both a monitoring and a violation curve as used in prior art.

FIG. 5*a* illustrates the grouping of sensors in the hoistway for checkpoint detection. As shown in FIG. 5*a*, four optical sensors mounted on an elevator car are used for checkpoint detection. Sensors 21, 22 and 23 are used to provide a three-bit binary code or the Checkpoint Identifier. Sensor 30 is a validation sensor which is used to indicate to a microprocessor-based controller that the sensing of the three sensors 21, 22 and 23 is valid. At each checkpoint, a long vane 5 and a short vane 7 are mounted by mounting means 40 in the hoistway to effect the sensing of the optical sensors. It should be understood that all the sensors are fixedly positioned on the elevator car. Furthermore, it is preferable to use a group of three sensors to provide a three-bit, binary coded signal to identify up to 8 checkpoints. However, a group of two sensors can also be used to provide a two-bit, binary coded checkpoint signal and, in general, a group of N sensors can be used to provide an N-bit, binary coded checkpoint signal.

FIG. 5*b* illustrates an optical sensor. As shown in FIG. 5*b*, a U-shaped optical sensor 30 has a pair of arms 24 and 25. Arm 25 has an optical transmitter 26 which transmits a beam of light over to a receiver (not shown) on arm 24. The sensing device 30 is mounted on the elevator car by means of a hole 28. In operation, when the device 30 passes by vane 7, the beam of light is broken and that fact is signaled to the microprocessor based controller that a checkpoint is present. Similarly, each of the sensing devices 21, 22 and 23 may have an optical transmitter and a receiver to sense the presence of vane 5.

FIG. 5*c* illustrates a vane having holes for providing a binary coded signal. For illustrative purposes only, vane 5 has two holes 11 and 13 to allow the light beam transmitted from transmitter 26 on one arm of the sensing device to reach the receiver on the other arm of the same sensing device. As shown, holes 11 and 13 are designed to match the position of sensors 21 and 23 when the light beam on the sensing device 30 is interrupted by vane 7. In this particular case, the binary coded three-bit signal provided by sensors 21, 22 and 23 can be either 010 or 101. It should be realized that the holes on vane 7, such as holes 11 and 13, can be replaced by slits, cutout portions or other apertures so as to provide one or more clear paths for light transmission between transmitters and respective receivers. Vane 7 can have 0, 1, 2, or 3 such holes or apertures.

FIG. 5*d* illustrates a vane having a plurality of light reflecting targets for providing a binary coded signal. As shown, two reflective targets or surfaces 31 and 33 are mounted on vane 5 to reflect light, in lieu of holes 11 and 13 for transmitting light as shown in FIG. 5*c*. In this case, the light transmitter 26 on sensor 30 (or 21, 22, 23) is replaced by a transmitter/receiver device, or an adjacently mounted transmitter-receiver pair. The receiver receives the light beam transmitted by the transmitter only when the beam is reflected by reflector 31 or 33. Alternatively, optical sensing devices 21, 22, 23 and 30 may be replaced by magnetic sensors to sense the variation of a magnetic field in the presence of a vane.

Although the invention has been shown and described with respect to a preferred embodiment thereof, it will be understood by those skilled in the art that the foregoing and various other changes, omissions and deviations in the form and detail thereof may be made without departing from the spirit and scope of this invention.

We claim:

1. A normal terminal stopping device, comprising:

an elevator hoistway terminal zone position checkpoint detection means utilizing a binary coding method for providing a binary coded output signal indicative of unique position checkpoints in an elevator hoistway terminal zone;

decision means, responsive to said binary coded output signal, for learning and retrieving a velocity reference signal corresponding to a position checkpoint associated with said binary coded signal and for comparing said velocity reference signal to a velocity command signal indicative of an actual velocity of the elevator car in said elevator hoistway for causing the elevator car to travel with a velocity corresponding to the velocity reference signal in the presence of said velocity command signal being greater than said velocity reference signal when traveling toward a terminal landing.

2. The normal terminal stopping device according to claim 1 wherein said hoistway terminal zone position checkpoint detection means comprises:

a stationary part having plural elongated sections, for vertical mounting along a terminal zone of an elevator hoistway; and a moving part, for mounting on an elevator car movable in said hoistway, for sensing said stationary part and for providing a sensed output signal indicative of said position checkpoint.

3. The normal terminal stopping device according to claim 2 wherein said elongated sections of said stationary part comprise vanes or other sensor targets for mounting along said terminal zone of said elevator hoistway.

4. The normal terminal stopping device according to claim 3 wherein said moving part comprises at least two sensing devices for providing said binary coded output signal containing at least two bits.

5. The normal terminal stopping device according to claim 4 wherein said moving part further comprises at least one validity sensor to validate said binary coded output signal.

6. The normal terminal stopping device according to claim 3 wherein said movable part comprises optical sensors for sensing said vanes or other sensor targets for providing said binary coded output signal containing at least two bits.

7. The normal terminal stopping device according to claim 3 wherein said movable part comprises optical sensors for sensing said vanes or other sensor targets for providing said binary coded output containing three bits.

8. The normal terminal stopping device according to claim 2 wherein said elongated sections of said stationary part comprise at least one light reflective means indicative of a checkpoint for mounting along said terminal zone of said elevator hoistway.

9. The normal terminal stopping device according to claim 8 wherein said movable part comprises optical sensors for sensing said vanes or other sensor targets for providing said binary coded output signal containing at least two bits.

10. The normal terminal stopping device according to claim 1 wherein said velocity reference signal is computed according to lead compensation and curve shaping techniques so as to attain better drive tracking characteristics of the motion controller.

11. The normal terminal stopping device of claim 1 wherein said position checkpoints detection means utilizing a binary coding method for providing a binary coded output signal indicative of a plurality of checkpoints including a first position checkpoint and a last position checkpoint, said first position checkpoint being located at a distance away from the level position of the terminal landing so as to alleviate the problems associated with the crowding phenomenon.

12. The normal terminal stopping device of claim 11 wherein said last position is determined by a velocity value approximately equal to a contract velocity.

13. A method of providing safety regarding the stopping of an elevator car in an elevator hoistway terminal zone comprising the steps of:

receiving a binary coded sensed output signal having a magnitude indicative of one of a plurality of position checkpoints in the hoistway terminal zone;

retrieving, in response to said binary coded sensed output signal, a velocity reference signal associated with said one checkpoint;

retrieving the car velocity command signal having a magnitude indicative of an actual velocity of the elevator car moving in the hoistway terminal zone; and comparing said car velocity command signal to said velocity reference signal for causing the elevator car to travel with a velocity corresponding to said velocity reference signal in the presence of said velocity command signal being greater than said velocity reference signal.

14. The method of claim 13 wherein said velocity reference signal is computed according to lead compensation and curve shaping techniques so as to attain better drive tracking characteristics of the motion controller.

* * * * *

UNITED STATES PATENT AND TRADEMARK OFFICE

CERTIFICATE OF CORRECTION

PATENT NO. : 6,082,498
DATED : July 4, 2000
INVENTOR(S) : Steven D. Coste et al.

It is certified that error appears in the above-identified patent and that said Letters Patent is hereby corrected as shown below:

Title page,
Item [54], the title should read -- NORMAL TERMINAL STOPPING DEVICE WITH NON-CRITICAL VANE SPACING --.

Signed and Sealed this

Fifteenth Day of January, 2002

*Attest:*

*Attesting Officer*

JAMES E. ROGAN
*Director of the United States Patent and Trademark Office*